US006988299B1

(12) United States Patent
Barrette et al.

(10) Patent No.: US 6,988,299 B1
(45) Date of Patent: Jan. 24, 2006

(54) MEMORIAL CONTAINER

(76) Inventors: Jeffery S. Barrette, 4617 Milwaukee St., Madison, WI (US) 53714; Richard A. Saric, 504 W. Madison St., Waterloo, WI (US) 53594; Darrell A. Klompmaker, 312 E. Main St., Marshall, WI (US) 53559

( * ) Notice: Subject to any disclaimer, the term of this patent is extended or adjusted under 35 U.S.C. 154(b) by 0 days.

(21) Appl. No.: 10/943,753

(22) Filed: Sep. 17, 2004

(51) Int. Cl.
*A61G 17/00* (2006.01)

(52) U.S. Cl. ..... 27/1

(58) Field of Classification Search ..... 27/1, 27/35; D99/5
See application file for complete search history.

(56) References Cited

U.S. PATENT DOCUMENTS

| | | | | |
|---|---|---|---|---|
| 5,379,499 | A | 1/1995 | Jackson | |
| 5,625,933 | A | 5/1997 | Neuberger et al. | |
| 5,647,108 | A | 7/1997 | Crook | |
| 5,704,103 | A | 1/1998 | Crowley et al. | |
| 5,729,921 | A | 3/1998 | Rojas | |
| 6,044,532 | A | 4/2000 | Bowling et al. | |
| 6,076,292 | A | 6/2000 | Kawa | |
| 6,175,995 | B1 | 1/2001 | Parker et al. | |
| 6,571,439 | B1 | 6/2003 | Sens | |
| 6,763,558 | B1 * | 7/2004 | Mytych | 27/2 |
| D509,638 | S * | 9/2005 | Moritz et al. | D99/5 |

OTHER PUBLICATIONS

Personalizing Cremation Urns, www.funeralplan.com/products/urnspersonalize.html, Jul. 4, 2004.
Personalization & Engraving Section, www.qualitycremation.com/personalizationsection.html, Jul. 4, 2004.
Cremation Urn Factory, www.cremationurnfactory.com/urnshowroom.html, Jul. 4, 2004.
Discounturns.coms, http://store.yahoo.com/discounturns/ex.html, Jul. 4, 2004.
Mainly Urns, http://store.mainelyurns.com/metal-urns.html, Jul. 4, 2004.
In The Light Urns, Memorial Urns, http://inthelighturns.com/catalog/product_info.
php?cPath=21&products_id=889, Jul. 4, 2004.
A Team Master's URNS, handcrafted cremation, custom or marble—German Silver urn, www.steammasters.com/urns.html, Jul. 4, 2004.
Eagle Custom Caskets, Inc., www.harleycaskets.com/, Jul. 4, 2004.
The Biker Ash Box, www.bikerashes.com/newindex1.html, Jul. 4, 2004.

* cited by examiner

*Primary Examiner*—William L. Miller
(74) *Attorney, Agent, or Firm*—Craig A. Fieschko, Esq.; DeWitt Ross & Stevens, S.C.

(57) ABSTRACT

A memorial container is formed of an engine block or a portion thereof which contains at least one engine cylinder wherein cremated remains can be stored. The portion of the engine block surrounding the cylinder is supported by a base closure, which closes one end of the cylinder, and is covered by a lid closure which closes the opposite end of the cylinder. The base closure preferably has an at least partially hollow interior which opens onto the engine cylinder, whereby cremated remains placed in the cylinder will also enter the interior of the base closure, with the base closure thereby providing greater effective storage volume for the cylinder.

19 Claims, 1 Drawing Sheet

MEMORIAL CONTAINER

FIELD OF THE INVENTION

This document concerns an invention relating generally to urns and other storage containers for cremated remains, and particularly to memorial containers for the remains of those who have an interest in motor vehicles and motorsports.

BACKGROUND OF THE INVENTION

People often wish to have their remains stored or disposed of in a manner which reflects their interests and hobbies. As examples, it is common for people to be buried with fishing lures, gardening equipment, or travel photos where these items reflect their hobbies and interests. In corresponding situations where cremation is chosen rather than burial, they might choose for their cremated remains to be scattered in rivers, gardens, or in various locations about the world. Other options include having a memorial marker (i.e., a gravestone) or cremation urn personalized to reflect the deceased's interests. Providers and carvers of memorial markers often have a number of stock images that can be chosen for placement on a marker (e.g., images of fishing and hunting activities, sporting images, etc.). Similarly, cremation urn providers often have a number of plaques and appliques dealing with interests/hobbies that can be chosen for affixation to a memorial container (e.g., a cremation urn).

For many, the current options for personalization are disappointing. Specifically considering the field of memorial containers for cremated remains, while some degree of personalization is possible, memorial containers are usually personalized by taking a stock container and retrofitting it with a stock image or text, and the resulting memorial container gives a limited impression of personalization: it still expresses very little of the deceased's personality, and it still appears to be a mass-produced, off-the-shelf item. Custom sculptures and castings can be commissioned, but these are exceedingly expensive and unaffordable for most people.

SUMMARY OF THE INVENTION

The invention, which is defined by the claims set forth at the end of this document, is a memorial container for the storage and display of cremated remains of people who had hobbies and interests in the field of motor vehicles, motorsports, and other fields that concern internal combustion engines, with the invention being intended to at least partially address some of the aforementioned problems in the memorial field. A brief summary of an exemplary version of the invention (depicted in the accompanying FIGS. 1 and 2) is now provided to give the reader a basic understanding of some of the preferred features of the invention, with more details being provided elsewhere in this document.

Referring to FIGS. 1 and 2 for a depiction of an exemplary version of the invention, the memorial container 100 is formed of at least a portion of an engine block 102 which contains at least one engine cylinder 104 (the cylinder 104 being visible in FIG. 1), with each cylinder 104 having its piston removed so that cremated remains can be stored within the cylinder 104. For example, the engine block portion 102 shown in FIGS. 1 and 2 is taken from a motorcycle engine wherein the engine block walls 106 that bound each cylinder may be removed from the remainder of the engine block (i.e., each cylinder 104 in the engine is independently removable from the engine), so the depicted engine block portion 102 merely includes a single cylinder. In other versions of the invention, more than one cylinder 104 might be included; for example, the engine block portion 102 might be a cutaway section of a solid engine block 102 which has two or more cylinders 104 defined therein, or it might in some cases be an entire engine block. In these latter cases, remains may be contained in one or more cylinders 104.

To maintain the cremated remains within the cylinder 104, the cylinder 104 is closed at its opposing ends by closures 108 and 110 attached to the engine block 102. One closure 108 preferably defines a base which supports the engine block 102, and this base closure 108 may be permanently or removably attached below the cylinder 104. The other closure 110 preferably defines a top lid which is removable from the engine block 102 to allow access to the interior of the cylinder 104 when desired.

Since the volume of a single cylinder 104 usually cannot accommodate the entire volume of a deceased person's cremated remains, the base closure 108 preferably has an at least partially hollow interior 112 (visible in FIG. 1), with the interior 112 of the base closure 108 opening onto the cylinder 104 so that remains placed within the cylinder 104 will be received in both the interior 112 of the base closure 108 and in the cylinder 104. The base closure 108 is depicted as having its interior 112 bounded by side walls 114, a top wall 116, and a bottom wall (not shown in the drawings) formed of seamlessly joined thin metal sheet or plate for sake of light weight and leak-free containment of remains, though other constructions are possible for the base closure 108. The use of the depicted box-like construction for the base closure 108 beneficially defines a pedestal for the memorial container 100 which allows significant storage volume, and at the same time allows ready display of names and other notations, which may be placed on the sidewalls 114 by engraving, by adhered nameplates, or by other means.

Certain characteristics of the memorial container 100 adapt the engine block 102 so that it is more easily displayed in standard settings, e.g., on mantels, shelves, and the like. The base closure 108 helps to stabilize the memorial container 100 so that it will not as readily tip from the weight of the (generally heavy) engine block 102, and the engine block 102 preferably extends upwardly (but not laterally outwardly) from the base closure 108 so that the engine block 102 does not interfere with a wall or other vertical surface when the base closure 108 is slid into abutment with the vertical surface.

Further advantages, features, and objects of the invention will be apparent from the following detailed description of the invention in conjunction with the associated drawings.

DETAILED DESCRIPTION OF PREFERRED VERSIONS OF THE INVENTION

The memorial container 100 described above is useful to anyone having an interest in motor vehicles and motorsports (e.g., to motorcycle aficionados and members of motorcycle clubs), and who desires something more than the conventional crematory urn to store and display cremated remains. One may choose an engine block 102 which relates to a particular make and model of engine which relates to the deceased's interests, and the engine block 102 may even be taken from the deceased's own vehicle (though scrap or used engine blocks 102 are usually economically available for use, allowing the deceased's vehicle to be maintained in its original condition).

Figure 1:
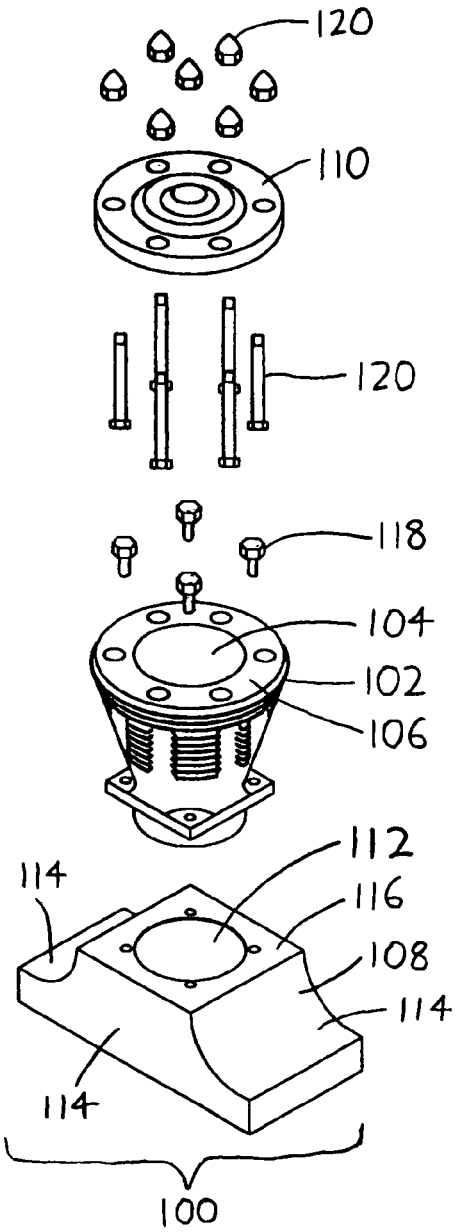
FIG. 1 is a front exploded perspective view of an exemplary memorial container 100 formed of a portion of a motorcycle engine block 102, more particularly a cylinder casing containing an engine cylinder 104 with its piston removed, with the engine block 102 being supported by a partially hollow base closure 108 and covered by a lid closure 110.
Figure 2:
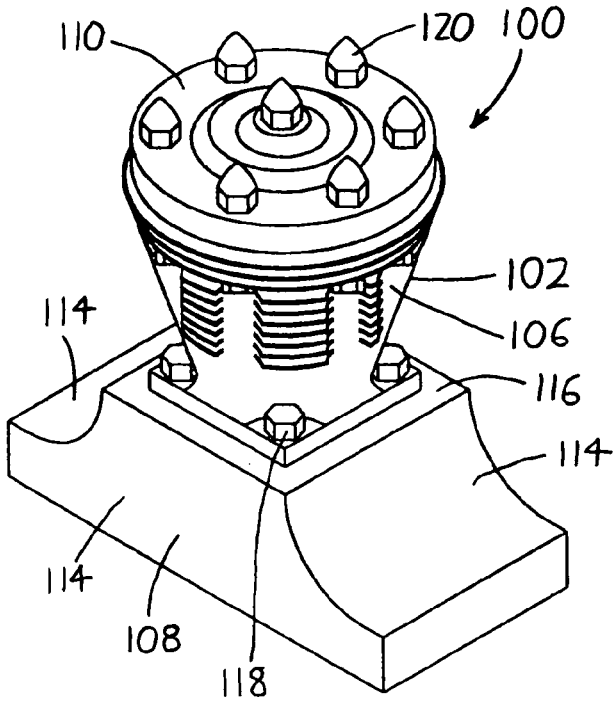
FIG. 2 is front perspective view of the assembled memorial container 100 of FIG. 1, wherein the engine block 102 is attached to the base closure 108 and lid closure 110 to allow cremated remains to be stored therein.

It should be understood that the engine block 102 can take a variety of forms different than that shown in the exemplary engine block 102 depicted in the drawings. Referring to FIGS. 1 and 2, the memorial container 100 includes a portion of an engine block 102 consisting of a removable cylinder casing for a single engine cylinder 104 (as may be found, for example, in certain types of motorcycle engines). However, where the deceased's interests relate to other types of engines, the engine block 102 may take other configurations, such as a cutaway section of an engine block 102 which contains one or more cylinders 104 (as may be appropriate for automotive engines, which usually contain multiple cylinders 104 defined in an integrally cast engine block 102). In other situations, an entire engine block 102 might be used. Where multiple cylinders 104 are present in the engine block 102, all or only some may open onto a hollow base closure 108, or if sufficient cylinder volume is present, none need open onto a hollow base closure 108 (and the base closure 108 need not be hollow). Where multiple cylinders 104 are present in the memorial container 100, it is also possible to separately store the cremated remains of multiple people, such as a husband and wife, or the members of a motorcycle club.

While it is preferred that all pistons be removed from the engine block 102 used in the memorial container 100 for sake of enhanced storage volume in the cylinder(s) 104 and for decreased size and weight, the piston(s) may be retained if desired, and may form one of the closures 108 or 110 by welding or otherwise affixing the piston(s) within the cylinder(s) 104. In this manner, the memorial container 100 may represent the point at which the engine stopped for the last time.

The base closure 108 can also take a variety of forms different from that of the exemplary hollow box-like base closure 108 depicted in FIGS. 1 and 2. The base closure 108 is preferably formed of seamlessly joined thin metal plate or sheet for sake of sturdiness (but light weight), particularly if the memorial container 100 should fall from a mantel or the like, and for leak-free construction. However, the base closure 108 can be made of other materials such as wood, ceramics, or plastics instead of (or in addition to) metals. Whatever the form and materials of the base closure 108, it preferably will remain the widest point of the memorial container 100 so that the base closure 108 forms a stable tip-resistant base for the memorial container 100, since the memorial container 100 will often be displayed on a mantel or the like, from which it would be undesirable to have the memorial container 100 fall (particularly because it may be quite heavy). It is also useful to have the engine block 102 and lid closure 110 extend upwardly, but not laterally outwardly, from the base closure 108 so that the base closure 108 may be slid against a wall or other vertical surface without interference from the engine block 102 and lid closure 110, thereby further enhancing stability.

Similarly, the lid closure 110 can take a variety of forms different than that shown in FIGS. 1 and 2. The depicted lid closure 110 is readily formed by turning metal stock on a lathe, but wooden or ceramic lid closures 110 are also possible. As with the base closure 108, the lid closure 110 may be formed to extend across and close one or multiple cylinders 104 in the event that multiple cylinders 104 are present in the memorial container 100. Where multiple cylinders 104 are present, it is also possible to simply use multiple lid closures 110.

In FIGS. 1 and 2, the base closure 108 and lid closure 110 are depicted as being fastened to the engine block 102 via base closure fasteners 118 and lid closure fasteners 120, but other forms of affixation are possible. In particular, the base closure 108 may be permanently welded to the engine block 102, though the lid closure 110 is preferably removably affixed to the engine block 102 for ease of access to the cylinder 104 (though permanent affixation of the lid closure 110 to the engine block 102 might occur once the remains are placed within the cylinder 104). Removable fastening can occur by any appropriate means, e.g., by fasteners 118, by engaging threads machined into the mouth of the cylinder 104, by hermetic sealing from a gasket engaging the mouth of the cylinder 104, and so forth.

The base closure 108 can accommodate some desired inscription, memorial plaque, applique, or other matter for further personalization; for example, apart from the deceased's name and dates of birth and death, it can bear the makes and models of the deceased's vehicle(s), his/her racing record or club affiliation, or similar matter. This may also be done at other areas of the memorial container 100, e.g., on the lid closure 110 or even on the engine block 102, but the base closure 108 will usually most easily accommodate engraving, adhesion of plaques or appliques, or the addition of other such matter. However, the lid closure 110 is particularly useful for addition of matter such as hood ornaments, vehicle nameplates, miniature vehicle models, and the like if additional personalization is desired.

The invention is not intended to be limited to the exemplary features described above, but rather is intended to be limited only by the claims set out below. Thus, the invention encompasses all different versions of memorial containers that fall literally or equivalently within the scope of these claims.

What is claimed is:

1. A cremated remains storage device which comprises:

a. at least a portion of an engine block, the portion containing at least one engine cylinder, the cylinder having no piston therein;

b. a base closure; and c. a lid closure;

wherein the base closure and lid closure close the engine cylinder such that cremated remains may be stored therein.

2. The device of claim 1 wherein the base closure is;

a. at least partially hollow, and b. contains an opening that opens onto the engine cylinder, whereby cremated remains placed within the engine cylinder are at least partially received by the base closure.

3. The device of claim 1 wherein the base closure is formed of seamlessly joined thin metal walls.

4. The device of claim 1 wherein the base closure and lid closure are attached to the engine block by fasteners.

5. The device of claim 1 wherein the lid closure has a lateral outer perimeter aligned with a lateral outer perimeter of the portion of the engine block to which the lid closure is engaged, whereby the lateral outer perimeter of the lid closure and lateral outer perimeter of the engine block form a continuous surface.

6. The device of claim 1 wherein:

a. the engine block is situated atop the base closure; and b. the engine block and lid closure are situated laterally inwardly from the base closure, whereby the engine block does not protrude laterally outwardly above the base closure.

7. The device of claim 6 wherein the base closure has a hollow interior which opens onto the engine cylinder.

8. The device of claim 7 wherein the engine block is formed from a motorcycle engine.

9. A cremated remains storage device comprising:

a. at least a portion of an engine block, the portion including at least one engine cylinder, the cylinder having no piston therein; and b. at least two closures;

wherein (1) the engine block is situated atop at least one of the closures; and (2) the closures close the engine cylinder, such that cremated remains may be stored therein.

10. The device of claim 9 wherein the closures are on opposing sides of the engine cylinder.

11. The device of claim 9 wherein at least one of the closures is:

a. at least partially hollow, and b. defines a base closure which at least partially supports the engine block.

12. The device of claim 9 wherein at least one of the closures has a hollow interior which opens onto the engine cylinder.

13. A cremated remains storage device comprising an engine cylinder bounded by:

a. engine block walls; and b. closures fixed on opposing sides of the engine cylinder, the closures being sized such that they cannot slide in the cylinder, the closures closing the engine cylinder so that cremated remains may be stored therein.

14. The device of claim 13 wherein one of the closures defines a base closure which supports at least a portion of the engine block walls.

15. The device of claim 14 wherein:

a. the other of the closures defines a lid closure, and b. the engine block and lid closure are situated laterally inwardly from the base closure.

16. The device of claim 13 wherein one closure defines a base closure which:

a. is at least partially hollow, and b. opens onto the engine cylinder.

17. The device of claim 13 wherein one closure defines a base closure comprising;

a. a top wall;

b. a bottom wall; and c. side walls, the walls being seamlessly joined, and surrounding a hollow base closure interior which opens onto the engine cylinder.

18. The device of claim 13 wherein:

a. one of the closures is a base closure formed of seamlessly joined walls bounding a hollow interior, the hollow interior opening onto the cylinder; and b. a motorcycle engine defines the cylinder and engine block walls.

19. The device of claim 13 wherein:

a. the engine cylinder has no adjacent engine cylinders within the engine block walls;

b. the engine cylinder is bounded at one end by one of the closures defining a lid closure; and c. the engine cylinder is bounded at its opposite end by the other of the closures defining a base closure including side walls, a top wall and a bottom wall;

the walls (1) surrounding an at least partially hollow interior opening onto the engine cylinder; and (2) being formed of seamless metal.

* * * * *